US009318055B2

(12) United States Patent
Kim et al.

(10) Patent No.: US 9,318,055 B2
(45) Date of Patent: Apr. 19, 2016

(54) STAGE CIRCUIT AND ORGANIC LIGHT EMITTING DISPLAY INCLUDING THE SAME

(71) Applicant: Samsung Display Co., LTD., Yongin, Gyeonggi-Do (KR)

(72) Inventors: Ji-Hye Kim, Yongin (KR); Seung-Kyu Lee, Yongin (KR); Ki-Myeong Eom, Yongin (KR)

(73) Assignee: SAMSUNG DISPLAY CO., LTD. (KR)

( * ) Notice: Subject to any disclaimer, the term of this patent is extended or adjusted under 35 U.S.C. 154(b) by 84 days.

(21) Appl. No.: 14/067,663

(22) Filed: Oct. 30, 2013

(65) Prior Publication Data

US 2014/0375616 A1 Dec. 25, 2014

(30) Foreign Application Priority Data

Jun. 21, 2013 (KR) ..... 10-2013-0071302

(51) Int. Cl.
*G09G 3/30* (2006.01)
*G09G 3/32* (2006.01)
*G09G 3/36* (2006.01)

(52) U.S. Cl.
CPC ..... *G09G 3/3266* (2013.01); *G09G 3/3275* (2013.01); *G09G 3/3611* (2013.01); *G09G 3/3674* (2013.01); *G09G 2310/0286* (2013.01)

(58) Field of Classification Search
USPC ..... 345/100
See application file for complete search history.

(56) References Cited

U.S. PATENT DOCUMENTS

2003/0128180 A1* 7/2003 Kim et al. ..... 345/100
2003/0231735 A1* 12/2003 Moon ..... G09G 3/3685 377/64
2005/0156856 A1* 7/2005 Jang et al. ..... 345/100
2007/0040771 A1* 2/2007 Chung et al. ..... 345/76
2009/0225013 A1* 9/2009 Lee ..... G09G 3/3233 345/80
2009/0225068 A1* 9/2009 Jeong et al. ..... 345/211
2011/0227884 A1 9/2011 Chung
2013/0088417 A1* 4/2013 Kim ..... G09G 3/3233 345/82
2014/0078029 A1 3/2014 Jang

FOREIGN PATENT DOCUMENTS

KR 1020110104320 A 9/2011
KR 1020140038148 3/2014

* cited by examiner

*Primary Examiner* — Linh N Hoffner
(74) *Attorney, Agent, or Firm* — Cantor Colburn LLP

(57) ABSTRACT

A stage circuit including a plurality of stages connected to each other, where each of the stages includes: an output unit configured to output a voltage of a first power source or a signal of a third input terminal to an output terminal, based on a voltage applied to a first node or a second node; a first driver configured to control a voltage at a third node, based on signals of a first input terminal, a second input terminal and the third input terminal; a second driver configured to control the voltage at the first node, based on the signal of the second input terminal and the voltage at the third node; and a first transistor connected between the second node and the third node and maintained in a turn-on state.

18 Claims, 5 Drawing Sheets

STAGE CIRCUIT AND ORGANIC LIGHT EMITTING DISPLAY INCLUDING THE SAME

This application claims priority to Korean Patent Application No. 10-2013-0071302, filed on Jun. 21, 2013, and all the benefits accruing therefrom under 35 U.S.C. §119, the contents of which in their entireties are herein incorporated by reference.

BACKGROUND

1. Field

Exemplary embodiments of the invention relate to a stage circuit and an organic light emitting display including the stage circuit.

2. Description of the Related Art

Flat panel displays include a liquid crystal display, a field emission display, a plasma display panel, an organic light emitting display, and the like.

Among the flat panel displays, the organic light emitting display displays an image using organic light emitting diodes that emit light through recombination of electrons and holes. The organic light emitting display typically has fast response speed and low power consumption. In a conventional organic light emitting display, current corresponding to a data signal is supplied to an organic light emitting diode, using a transistor included in each pixel, such that light is generated in the organic light emitting diode.

SUMMARY

Exemplary embodiments of the invention provide a stage circuit and an organic light emitting display including the stage circuit, with improved stability.

According to an exemplary embodiment of the invention, A stage circuit including a plurality of stages connected to each other, where each of the stages includes: an output unit configured to output a voltage of a first power source or a signal of a third input terminal to an output terminal, based on a voltage applied to a first node or a second node; a first driver configured to control a voltage at a third node, based on signals of a first input terminal, a second input terminal and the third input terminal; a second driver configured to control the voltage at the first node, based on the signal of the second input terminal and the voltage at the third node; and a first transistor connected between the second and third nodes and maintained in a turn-on state.

In an exemplary embodiment, the first input terminal may receive an output signal of a previous stage or a start signal, and the second input terminal may receive one of a first clock signal and a second clock signal, and the third input terminal may receive the other of the first clock signal and the second clock signal.

In an exemplary embodiment, the first and second clock signals may have substantially a same period, and turn-on periods of the first and second clock signals may not overlap each other.

In an exemplary embodiment, the first and second clock signals may have a period of two horizontal periods, and the turn-on periods of the first and second clock signals may be in different horizontal periods from each other.

In an exemplary embodiment, a turn-on period of the start signal may overlap a turn-on period of the first clock signal.

In an exemplary embodiment, the first driver may include a second transistor connected between the first input terminal and the third node, where a gate electrode of the second transistor is connected to the second input terminal; and third and fourth transistors connected in series to each other and connected between the third node and the first power source, where a gate electrode of the third transistor is connected to the third input terminal, and a gate electrode of the fourth transistor is connected to the first node.

In an exemplary embodiment, the output unit may include a fifth transistor connected between the first power source and the output terminal, where a gate electrode of the fifth transistor is connected to the first node; a sixth transistor connected between the output terminal and the third input terminal, where a gate electrode of the sixth transistor is connected to the second node; a first capacitor connected between the second node and the output terminal; and a second capacitor connected between the first node and the first power source.

In an exemplary embodiment, the second driver may include a seventh transistor connected between the first node and the second input terminal, where a gate electrode of the seventh transistor is connected to the third node; and an eighth transistor connected between the first node and a second power source set to a voltage lower than that of the first power source, where a gate electrode of the eighth transistor is connected to the second input terminal.

In an exemplary embodiment, a gate electrode of the first transistor may be connected to the second power source.

According to another exemplary of the invention, there is provided an organic light emitting display, including: pixels connected in an area defined by scan lines and data lines; a data driver configured to supply a data signal to the data lines; and a scan driver configured to supply a scan signal to the scan lines, where the scan driver includes a plurality of stages connected each other, and each of the stages is connected to a corresponding scan line of the scan lines, and each of the stages includes: an output unit configured to output a voltage of a first power source or a signal of a third input terminal to an output terminal, based on a voltage applied to a first node or a second node; a first driver configured to control a voltage at a third node, based on signals of a first input terminal, a second input terminal and the third input terminal; a second driver configured to control the voltage at the first node, based on the signal of the second input terminal and the voltage at the third node; and a first transistor connected between the second and third nodes and maintained in a turn-on state.

In an exemplary embodiment, each of the stages may generate the scan signal based on a clock signal supplied to the third input terminal.

In an exemplary embodiment, the first input terminal may receive a scan signal of a previous stage or a start signal.

In an exemplary embodiment, the second and third input terminals of an odd-numbered stage of the stages may receive a first clock signal and a second clock signal, respectively, and the second and third input terminals of an even-numbered stage of the stages may receive the second clock signal and the first clock signal, respectively.

In an exemplary embodiment, the first and second clock signals may have the same period, and turn-on period of the first and second clock signals may not overlap each other.

In an exemplary embodiment, the first driver may include a second transistor connected between the first input terminal and the third node, where a gate electrode of the second transistor is connected to the second input terminal; and third and fourth transistors connected in series to each other and connected between the third node and the first power source, where a gate electrode of the third transistor is connected to the third input terminal, and a gate electrode of the fourth transistor is connected to the first node.

In an exemplary embodiment, the output unit may include a fifth transistor connected between the first power source and the output terminal, where a gate electrode of the fifth transistor is connected to the first node; a sixth transistor connected between the output terminal and the third input terminal, where a gate electrode of the sixth transistor is connected to the second node; a first capacitor connected between the second node and the output terminal; and a second capacitor connected between the first node and the first power source.

In an exemplary embodiment, the second driver may include a seventh transistor connected between the first node and the second input terminal, where a gate electrode of the seventh transistor is connected to the third node; and an eighth transistor connected between the first node and a second power source having a voltage lower than the voltage of the first power source, where a gate electrode of the eighth transistor is connected to the second input terminal.

In an exemplary embodiment, a gate electrode of the first transistor may be connected to the second power source.

BRIEF DESCRIPTION OF THE DRAWINGS

The above and other features of the invention will become more apparent by describing in detail exemplary embodiments thereof with reference to the attached drawings, in which.

DETAILED DESCRIPTION

Figure 1:
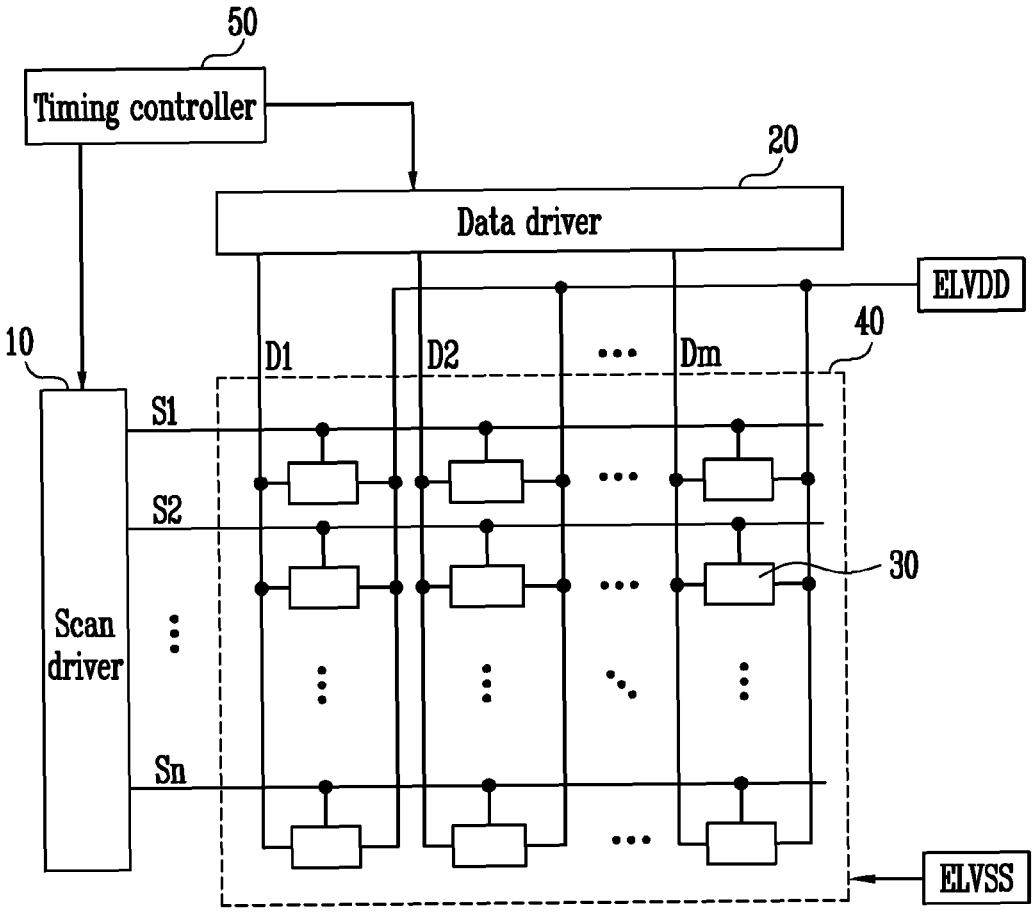
FIG. 1 is a block diagram illustrating an exemplary embodiment of an organic light emitting display according to the invention.

The invention will be described more fully hereinafter with reference to the accompanying drawings, in which embodiments of the invention are shown. This invention may, however, be embodied in many different forms, and should not be construed as limited to the embodiments set forth herein. Rather, these embodiments are provided so that this disclosure will be thorough and complete, and will fully convey the scope of the invention to those skilled in the art. Like reference numerals refer to like elements throughout.

It will be understood that when an element or layer is referred to as being "on", "connected to" or "coupled to" another element or layer, it can be directly on, connected or coupled to the other element or layer or intervening elements or layers may be present. In contrast, when an element is referred to as being "directly on," "directly connected to" or "directly coupled to" another element or layer, there are no intervening elements or layers present. Like numbers refer to like elements throughout. As used herein, the term "and/or" includes any and all combinations of one or more of the associated listed items.

It will be understood that, although the terms first, second, etc. may be used herein to describe various elements, components, regions, layers and/or sections, these elements, components, regions, layers and/or sections should not be limited by these terms. These terms are only used to distinguish one element, component, region, layer or section from another element, component, region, layer or section. Thus, a first element, component, region, layer or section discussed below could be termed a second element, component, region, layer or section without departing from the teachings of the invention.

Spatially relative terms, such as "beneath", "below", "lower", "above", "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the exemplary term "below" can encompass both an orientation of above and below. The device may be otherwise oriented (rotated 90 degrees or at other orientations) and the spatially relative descriptors used herein interpreted accordingly.

The terminology used herein is for the purpose of describing particular embodiments only and is not intended to be limiting of the invention. As used herein, the singular forms, "a", "an" and "the" are intended to include the plural forms as well, unless the context clearly indicates otherwise. It will be further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

"About" or "approximately" as used herein is inclusive of the stated value and means within an acceptable range of deviation for the particular value as determined by one of ordinary skill in the art, considering the measurement in question and the error associated with measurement of the particular quantity (i.e., the limitations of the measurement system). For example, "about" can mean within one or more standard deviations, or within ±30%, 20%, 10%, 5% of the stated value.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Embodiments are described herein with reference to cross section illustrations that are schematic illustrations of idealized embodiments. As such, variations from the shapes of the illustrations as a result, for example, of manufacturing techniques and/or tolerances, are to be expected. Thus, embodiments described herein should not be construed as limited to the particular shapes of regions as illustrated herein but are to include deviations in shapes that result, for example, from manufacturing. For example, a region illustrated or described as flat may, typically, have rough and/or nonlinear features. Moreover, sharp angles that are illustrated may be rounded. Thus, the regions illustrated in the figures are schematic in nature and their shapes are not intended to illustrate the precise shape of a region and are not intended to limit the scope of the claims set forth herein.

All methods described herein can be performed in a suitable order unless otherwise indicated herein or otherwise clearly contradicted by context. The use of any and all examples, or exemplary language (e.g., "such as"), is intended merely to better illustrate the invention and does not pose a limitation on the scope of the invention unless otherwise claimed. No language in the specification should be construed as indicating any non-claimed element as essential to the practice of the invention as used herein.

Hereinafter, exemplary embodiments of the invention will be described in further detail with reference to the accompanying drawings.

FIG. 1 is a block diagram illustrating an exemplary embodiment of an organic light emitting display according to the invention.

Referring to FIG. 1, an exemplary embodiment of the organic light emitting display includes a pixel unit 40 including a plurality of pixels 30 arranged substantially in a matrix form and connected to a plurality of scan lines S1 to Sn and a plurality of data lines D1 to Dm, a scan driver 10 configured to drive the scan lines S1 to Sn, a data driver 20 configured to drive the data lines D1 to Dm, and a timing controller 50 configured to control the scan driver 10 and the data driver 20.

In such an embodiment, the scan driver 10 supplies a scan signal to the scan lines S1 to Sn. In one exemplary embodiment, for example, the scan driver 10 may sequentially apply the scan signal to the scan lines S1 to Sn. In such an embodiment, the scan lines S1 to Sn extend substantially in a pixel row direction, and the pixels 30 disposed in each pixel row are connected to a corresponding scan line. In an exemplary embodiment, the scan driver 10 includes stage circuits (not shown) coupled to the scan lines S1 to Sn, respectively.

The data driver 20 supplies a data signal to the data lines D1 to Dm, in synchronization with the scan signals. Then, a voltage corresponding to the data signal is charged into the pixels 30 based on the scan signals.

The timing controller 50 controls the scan driver 10 and the data driver 20. The timing controller 50 transmits data (not shown) from the outside of the organic light emitting display to the data driver 20.

The pixels 30 are controlled by the scan signal supplied thereto to be charged by a voltage corresponding to the data signal. The pixels 30 generate light with a predetermined luminance when a current corresponding to the charged voltage is supplied to an organic light emitting diode (not shown) of the pixels.

In an exemplary embodiment, as shown in FIG. 1, a first voltage ELVDD and a second voltage ELVSS are applied to the pixel unit 40. In such an embodiment, the first and second voltages ELVDD and ELVSS may be power supply voltages applied to the pixels 30 of the pixel unit 40.

Figure 2:
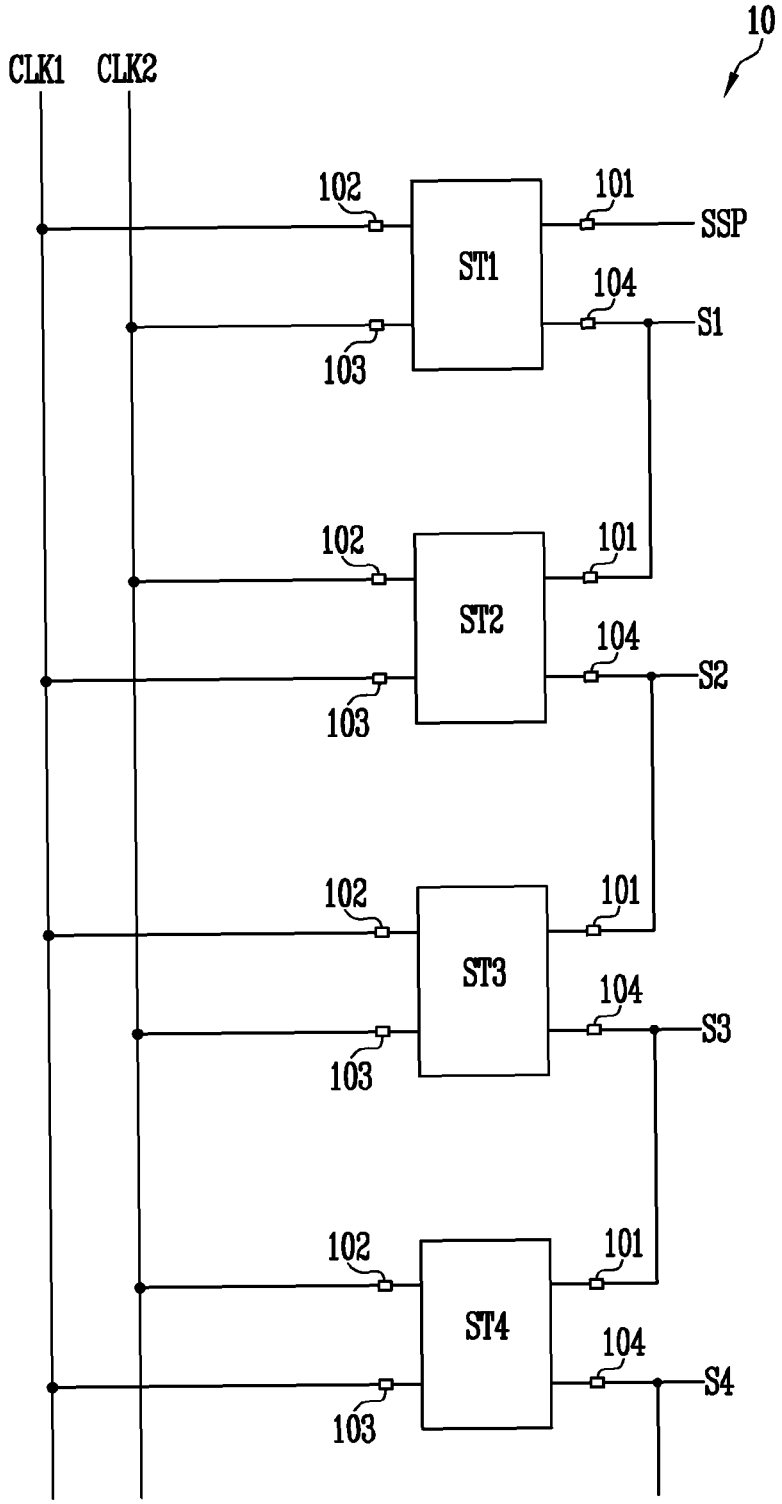
FIG. 2 is a block diagram illustrating an exemplary embodiment of a scan driver shown in FIG. 1.

FIG. 2 is a diagram illustrating an exemplary embodiment of the scan driver shown in FIG. 1. For convenience of illustration, four stages are shown in FIG. 2, but not being limited thereto.

Referring to FIG. 2, an exemplary embodiment of the scan driver 10 includes a plurality of stages, e.g., first to fourth stages ST1 to ST4. Each of the stages ST1 to ST4 is coupled to a corresponding scan line of a plurality of scan lines S1 to S4, and is driven based on a plurality of clock signals, e.g., a first clock signal CLK1 and a second clock signal CLK2. The stages ST1 to ST4 may be configured with substantially the same circuit as each other.

Each of the stages ST1 to ST4 includes first to third input terminals 101 to 103 and an output terminal 104.

The first input terminal 101 of each of the stages ST1 to ST4 receives an output signal (i.e., a scan signal) of a previous stage thereof or a start signal SSP. In one exemplary embodiment, for example, the first input terminal 101 of the first stage ST1 receives the start signal SSP, and the input terminal 101 of each of the subsequent stages, e.g., the second to fourth stages ST2 to ST4, receives the output signal of the previous stage thereof.

Figure 4:
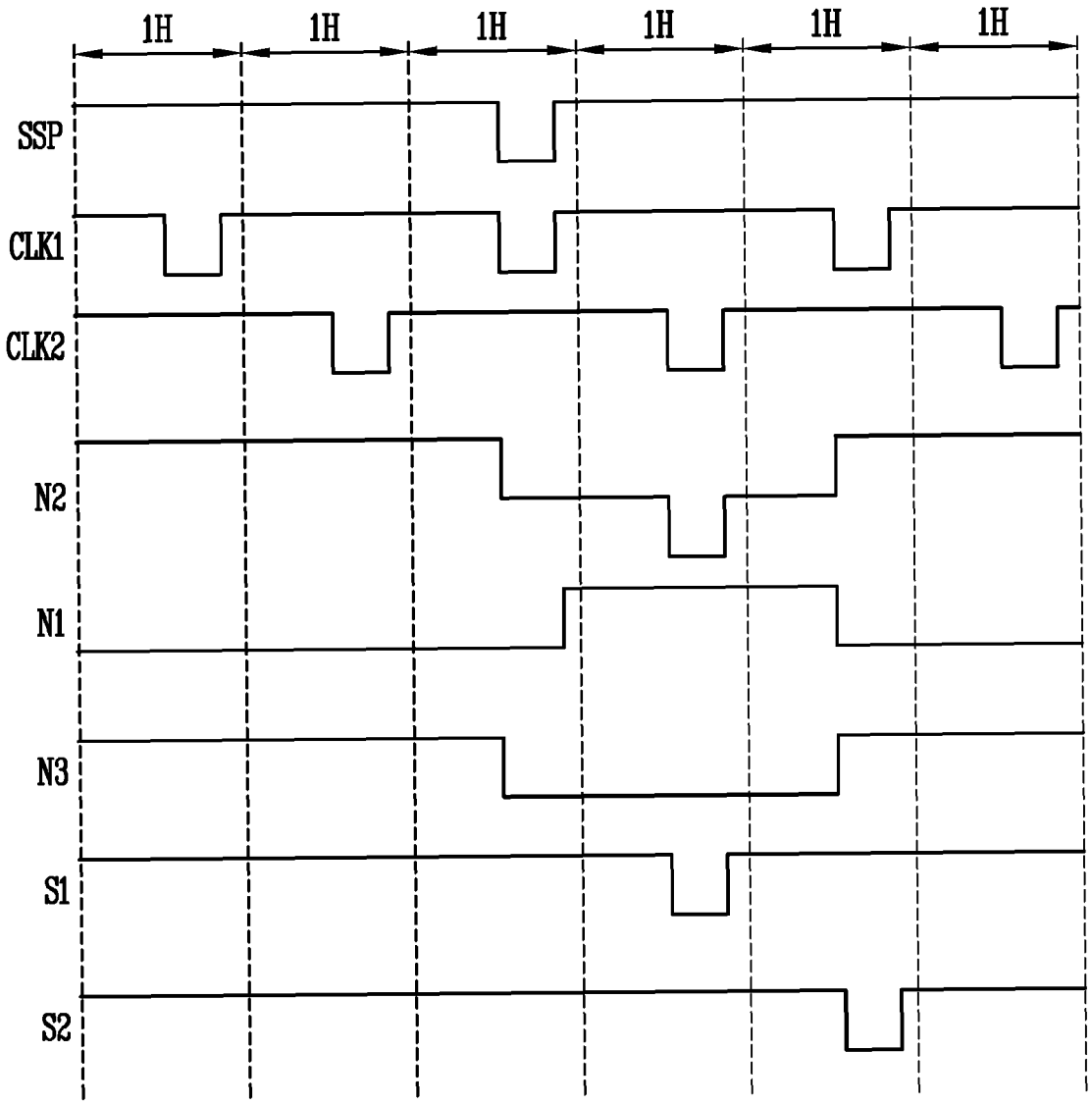
FIG. 4 is a signal timing diagram illustrating an exemplary embodiment of a driving method of a stage circuit shown in FIG. 3.

In an exemplary embodiment, the second and third input terminals 102 and 103 of an (2i−1)-th stage receive the first and second clock signals CLK1 and CLK2, respectively, and the second and third input terminals 102 and 103 of an 2i-th stage receive the second and first clock signals CLK2 and CLK1, respectively. Herein, i is a natural number. In an alternative exemplary embodiment, the second and third input terminals 102 and 103 of the (2i−1)-th stage receive the second and first clock signals CLK2 and CLK1, respectively, and the second and third input terminals 102 and 103 of the 2i-th stage receive the first and second clock signals CLK1 and CLK2, respectively In an exemplary embodiment, the first and second clock signals CLK1 and CLK2 have substantially the same period, and the first and second clock signals CLK1 and CLK2 have turn-on voltages during different time periods from each other. In such an embodiment, the phase difference of the first and second clock signals CLK1 and CLK2 may be greater than a pulse width thereof. In such an embodiment, the phase difference of the first and second clock signals CLK1 and CLK2 may be about one horizontal period (1H). In one exemplary embodiment, for example, when assuming that the period in which a scan signal is supplied to one scan signal is referred to as one horizontal period (1H), each of the first and second clock signals CLK1 and CLK2 has a period of two horizontal periods (2H), and pulses (e.g., inverted pulses as shown in FIG. 4) of the first and second clock signals have a pulse width less than one horizontal period (1H) and are supplied in different horizontal periods.

Figure 3:
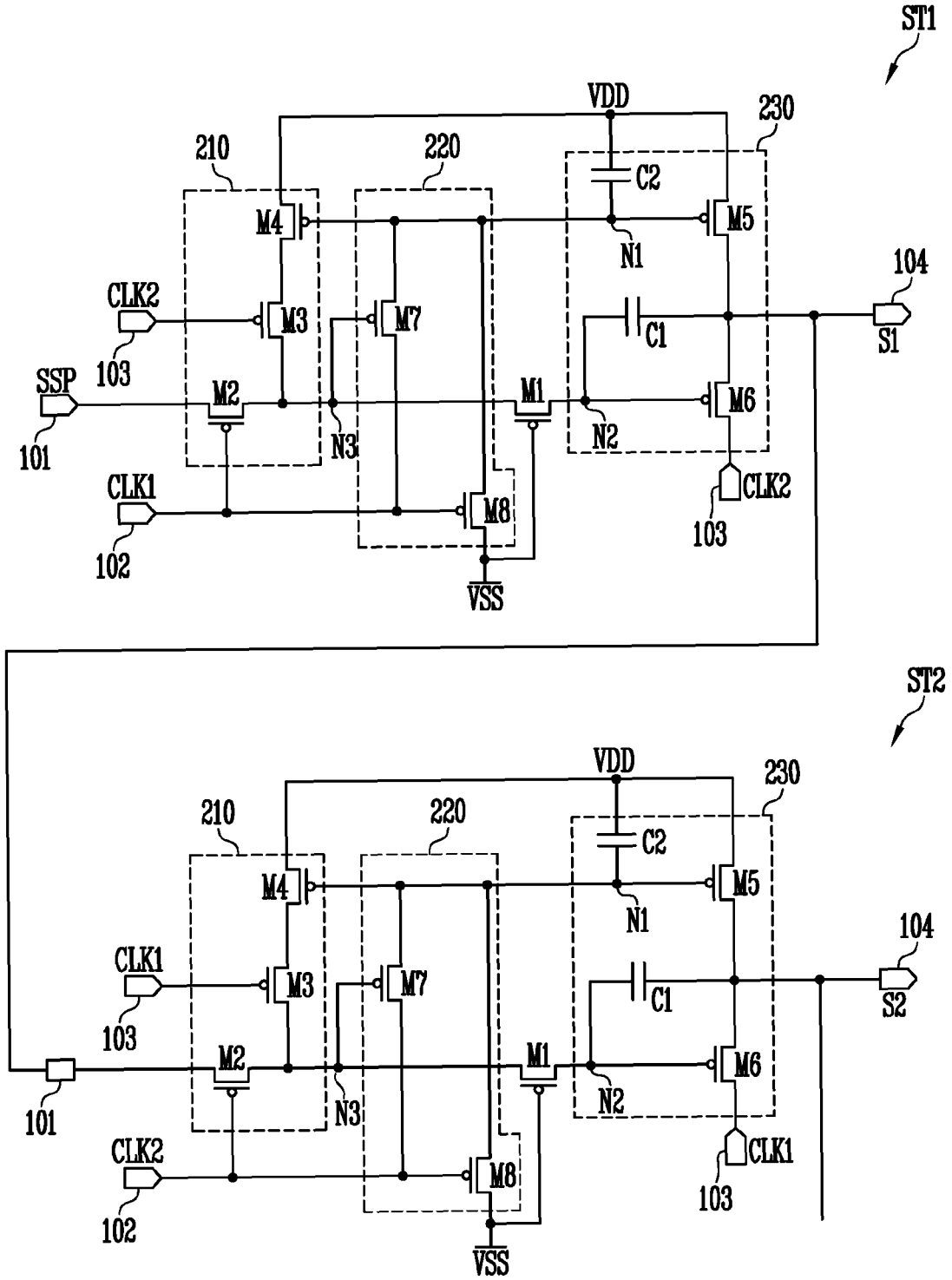
FIG. 3 is a circuit diagram illustrating an exemplary embodiment of stages shown in FIG. 2.

FIG. 3 is a circuit diagram illustrating an exemplary embodiment of the stages shown in FIG. 2. For convenience of illustration, the first and second stages ST1 and ST2 are shown in FIG. 3. In an exemplary embodiment, as shown in FIG. 3, transistors in the stages may be p-type metal oxide semiconductor ("PMOS") transistors, but the invention is not limited thereto. In one alternative exemplary embodiment, for example, the transistors may be n-type metal oxide semiconductor ("NMOS") transistors.

Referring to FIG. 3, in an exemplary embodiment, the first stage ST1 includes a first driver 210, a second driver 220, an output unit 230 and a first transistor M1.

The output unit 230 controls a voltage supplied to the output terminal 104, based on a voltage applied to first and second nodes N1 and N2. In an exemplary embodiment, the output unit 230 includes a fifth transistor M5, a sixth transistor M6, a first capacitor C1 and a second capacitor C2.

The fifth transistor M5 is connected between a first power source VDD and the output terminal 104, and a gate electrode of the fifth transistor M5 is coupled or connected to the first node N1. The fifth transistor M5 controls the coupling or the connection between the first power source VDD and the output terminal 104, based on the voltage applied to the first node N1. In such an embodiment, the first power source VDD may be set to a gate-off voltage, e.g., a high-level voltage.

The sixth transistor M6 is connected between the output terminal 104 and the third input terminal 103, and a gate electrode of the sixth transistor M6 is coupled or connected to the second node N2. The sixth transistor M6 controls the coupling or the connection between the output terminal 104 and the third input terminal 103, based on the voltage applied to the second node N2.

The first capacitor C1 is coupled or connected between the second node N2 and the output terminal 104. The first capacitor C1 charges a voltage corresponding to the turn-on or turn-off of the sixth transistor M6.

The second capacitor C2 is coupled or connected between the first node N1 and the first power source VDD. The second capacitor C2 charges the voltage applied to the first node N1.

The first driver 210 controls a voltage at a third node N3, based on signals supplied to the first to third input terminals 101 to 103, respectively. In an exemplary embodiment, the first driver 210 includes second to fourth transistors M2 to M4.

The second transistor M2 is disposed or connected between the first input terminal 101 and the third node N3, and a gate electrode of the second transistor M2 is coupled or connected to the second input terminal 102. The second transistor M2 controls the coupling or the connection between the first input terminal 101 and the third node N3, based on the signal supplied to the second input terminal 102.

The third and fourth transistors M3 and M4 are coupled or connected in series to each other between the third node N3 and the first power source VDD. In such an embodiment, the third transistor M3 is disposed or connected between the fourth transistor M4 and the third node N3, and a gate electrode of the third transistor M3 is coupled or connected to the third input terminal 103. The third transistor M3 controls the coupling between the fourth transistor M4 and the third node N3, based on the signal supplied to the third input terminal 103.

The fourth transistor M4 is disposed or connected between the third transistor M3 and the first power source VDD, and a gate electrode of the fourth transistor M4 is coupled or connected to the first node N1. The fourth transistor M4 controls the coupling between the third transistor M3 and the first power source VDD, based on the voltage at the first node N1.

The second driver 220 controls the voltage at the first node N1, based on the voltage at the second input terminal 102 and the voltage at the third node N3. In an exemplary embodiment, the second driver 220 includes seventh and eighth transistors M7 and M8.

The seventh transistor M7 is disposed or connected between the first node N1 and the second input terminal 102, and a gate electrode of the seventh transistor M7 controls the coupling or the connection between the first node N1 and the second input terminal 102, based on the voltage at the third node N3.

The eighth transistor M8 is disposed or connected between the first node N1 and a second power source VSS, and a gate electrode of the eighth transistor M8 is coupled or connected to the second input terminal 102. The eighth transistor M8 controls the coupling or the connection between the first node N1 and the second power source VSS, based on the signal supplied to the second input terminal 102. In such an embodiment, the second power source VSS may be set to a gate-on voltage, e.g., a low-level voltage.

The first transistor M1 is disposed or connected between the third node N3 and the second node N2, and a gate electrode of the first transistor M1 is coupled or connected to the second power source VSS. The first transistor M1 maintains the coupling or the connection between the third and second nodes N3 and N2, while maintaining the turn-on state of the first transistor M1. In such an embodiment, the first transistor M1 limits the voltage drop width of the third node N3, based on the voltage at the second node N2. In such an embodiment, when the voltage at the second node N2 is dropped to a voltage lower than the voltage of the second power source VSS, the voltage at the third node N3 is not lower than a voltage obtained by subtracting the threshold voltage of the first transistor M1 from the voltage of the second power source VSS. The limited voltage drop width of the third node N3 will be described later in greater detail.

FIG. 4 is a signal timing diagram illustrating an exemplary embodiment of a driving method of the stage circuit shown in FIG. 3. In FIG. 4, for convenience of illustration, an operation process of the stage circuit will be described with signals applied to the first stage ST1.

Referring to FIG. 4, each of the first and second clock signals CLK1 and CLK2 has a period of two horizontal periods (2H), and the first and second clock signals are supplied in different horizontal periods. The start signal SSP is supplied in synchronization with the first or second clock signal CLK1 or CLK2 supplied to the second input terminal 101. In such an embodiment, a signal applied to the stage circuit, e.g., the first clock signal CLK1, the second clock signal or the start signal SSP, has a turn-on voltage for turning on the transistors in the stage circuit, and a turn-on period of the signal is defined as a period during which the signal has the turn-on voltage.

An exemplary embodiment of the operating process of the stage circuit will be described in detail. In such an embodiment, a turn-on period of the start signal SSP overlaps a turn-on period of the first clock signal CLK1. In one exemplary embodiment, for example, the start signal SSP is supplied in synchronization with the first clock signal CLK1, as shown in a third horizontal period of FIG. 4.

As shown in FIGS. 3 and 4, when a turn-on voltage (e.g., the low voltage) of the first clock signal CLK1 is supplied, the second and eighth transistors M2 and M8 are turned on in response to a turn-on voltage, e.g., a low-level voltage, of the first clock signal CLK1. When the second transistor M2 is turned on, the first input terminal 101 and the third node N3 are electrically coupled or connected to each other. In such an embodiment, the first transistor M1 is maintained in the turn-on state by the second power source VSS, such that the electrical coupling or connection between the second and third nodes N2 and N3 is maintained.

When the first input terminal 101 and the third node N3 are electrically coupled or connected to each other, the third and second nodes N3 and N2 are set to a low voltage by a turn-on voltage (e.g., the low voltage) of the start signal SSP supplied to the first input terminal 101. When the third and second nodes N3 and N2 are set to the low voltage, the sixth and seventh transistors M6 and M7 are turned on.

When the sixth transistor M6 is turned on, the third input terminal 103 and the output terminal 104 are electrically coupled or connected to each other. In such an embodiment, the third input terminal 103 receives a turn-off voltage, e.g., a high voltage, of the second clock signal CLK2 when the first clock signal CLK1 has the low voltage, and the high voltage is thereby also output to the output terminal 104. When the seventh transistor M7 is turned on, the second input terminal 102 and the first node N1 are electrically coupled or connected to each other. Then, the voltage of the first clock signal CLK1 supplied to the second input terminal 102, e.g., the low voltage, is supplied to the first node N1.

When a turn-on voltage (e.g., the low voltage) of the first clock signal CLK1 is supplied, the eighth transistor M8 is turned on. When the eighth transistor M8 is turned on, the voltage of the second power source VSS is supplied to the first node N1. In an exemplary embodiment, the voltage of the second power source VSS is set as a voltage substantially the same as the voltage of the first clock signal CLK1, such that the first node N1 substantially stably maintains the low voltage.

When the first node N1 is set to the low voltage, the fourth and fifth transistors M4 and M5 are turned on. When the fourth transistor M4 is turned on, the first power source VDD and the third transistor M3 are electrically coupled or connected to each other. In an exemplary embodiment, the third transistor M3 is set in the turn-off state, such that the third node N3 substantially stably maintains the low voltage when the fourth transistor M4 is turned on. When the fifth transistor M5 is turned on, the voltage of the first power source VDD is supplied to the output terminal 104. In such an embodiment, the voltage of the first power source VDD is set as a voltage substantially the same as the high voltage supplied to the third input terminal 103, such that the output terminal 104 substantially stably maintains the high voltage.

Subsequently, as shown in the third horizontal period of FIG. 4, the supply of the start signal SSP and the first clock signal CLK1 is stopped, e.g., the voltage level of the start signal SSP and the first clock signal CLK1 is converted from a low voltage to a high voltage. When the supply of the first clock signal CLK1 is stopped, the second and eighth transistors M2 and M8 are turned off. When the supply of the first clock signal CLK1 is stopped, the sixth and seventh transistors M6 and M7 maintain the turn-on state, by the voltage stored in the first capacitor C1. Accordingly, in such an embodiment, the low voltage is maintained at the second and third nodes N2 and N3 by the voltage stored in the first capacitor C1.

When the sixth transistor M6 maintains the turn-on state, the electrical coupling or connection between the output terminal 104 and the third input terminal 103 is maintained. When the seventh transistor M7 maintains the turn-on state, the electrical coupling or connection between the first node N1 and the second input terminal 102 is maintained. In such an embodiment, the voltage at the second input terminal 102 is set as the high voltage, such that the first node N1 is also set to the high voltage. When the high voltage is supplied to the first node N1, the fourth and fifth transistors M4 and M5 are turned off.

Subsequently, as shown in a fourth horizontal period of FIG. 4, a turn-on voltage (e.g., the low voltage) of the second clock signal CLK2 is supplied to the third input terminal 103, e.g., the voltage level of the second clock signal CLK2 is converted from a high voltage to a low voltage. When the turn-on voltage (e.g., the low voltage) of the second clock signal CLK2 is supplied to the third input terminal 103, the sixth transistor M6 is set in the turn-on state, such that the turn-on voltage (e.g., the low voltage) of the second clock signal CLK2 supplied to the third input terminal 103 is supplied to the output terminal 104, and the output terminal 104 outputs the second clock signal CLK2 as a scan signal to the scan line S1.

When the turn-on voltage (e.g., the low voltage) of the second clock signal CLK2 is supplied to the output terminal 104, the voltage at the second node N2 is dropped to a voltage lower than the voltage of the second power source VSS, such that the sixth transistor M6 substantially stably maintains the turn-on state.

When the voltage at the second node N2 is dropped, a voltage substantially close to the voltage of the second power source VSS (e.g., the voltage obtained by subtracting the threshold voltage of the first transistor M1 from the voltage of the second power source VSS) is maintained at third node N3 by the first transistor M1.

The supply of the second clock signal CLK2 is stopped after the scan signal is output to the scan line S1. When the supply of the second clock signal CLK2 is stopped, the high voltage is output through the output terminal 104. The voltage at the second node N2 is increased to the voltage substantially close to the voltage of the second power source VSS (e.g., the voltage obtained by subtracting the threshold voltage of the first transistor M1 from the voltage of the second power source VSS), based on the high voltage at the output terminal 104.

Subsequently, as shown in a fifth horizontal period of FIG. 4, the turn-on voltage (e.g., the low voltage) of the first clock signal CLK1 is supplied, e.g., the voltage level of the first clock signal CLK1 is converted from a high voltage to a low voltage. When the turn-on voltage (e.g., the low voltage) of the first clock signal CLK1 is supplied, the second and eighth transistors M2 and M8 are turned on. When the second transistor M2 is turned on, the first input terminal 101 and the third node N3 are electrically coupled or connected to each other. In this horizontal period, the turn-on voltage (e.g., the low voltage) of the start signal SSP is not supplied to the first input terminal 101, that is, a turn-off voltage (e.g., the high voltage) of the start signal SSP is supplied to the first input terminal 101, such that the first input terminal 101 is set to the high voltage. Thus, when the first transistor M1 is turned on, the turn-off voltage (e.g., the high voltage) is supplied to the third and second nodes N3 and N2, such that the sixth and seventh transistors M6 and M7 are turned on.

When the eighth transistor M8 is turned on, the voltage (e.g., the turn-off voltage or the high voltage) of the second power source VSS is supplied to the first node N1, such that the fourth and fifth transistors M4 and M5 are turned on. If the fifth transistor M5 is turned on, the voltage of the first power source VDD is supplied to the output terminal 104. Subsequently, the fourth and fifth transistors M4 and M5 maintain the turn-on state, by the voltage charged in the second capacitor C2, such that the output terminal 104 substantially stably receives the voltage of the first power source VDD.

Subsequently, as shown in a sixth horizontal period of FIG. 4, the third transistor M3 is turned on when the turn-on voltage (e.g., the low voltage) of the second clock signal CLK2 is supplied. In this horizontal period, the fourth transistor M4 is set in the turn-on state, such that the voltage of the first power source VDD is supplied to the third and second nodes N3 and N2, and the sixth and seventh transistors M6 and M7 substantially stably maintain the turn-off state.

The second stage ST2 receives the output signal (e.g., the scan signal) of the first stage ST1, in synchronization with the second clock signal CLK2 as shown in the fourth horizontal period of FIG. 4. In such an embodiment, the second stage ST2 outputs the scan signal to the second scan line S2, in synchronization with the first clock signal CLK1. Accordingly, in such an embodiment, the stages ST of the invention sequentially output the scan signal by the procedure described above.

In an exemplary embodiment of the invention, the first transistor M1 limits the minimum voltage width of the third node N3, regardless of the voltage at the second node N2, such that the manufacturing cost is substantially reduced and the reliability of driving is substantially improved.

In such an embodiment, when the scan signal is supplied to the output terminal 104, the voltage at the second node N2 is dropped to a voltage of about VSS−(VDD−VSS). In one exemplary embodiment, when the voltage of the first power source VDD is about 7 volts (V) and the voltage of the second power source VSS is about −8 V, the voltage at the second node N2 may be dropped to about −20 V based on the threshold voltages of the transistors.

In a stage circuit, where the first transistor M1 is omitted, the voltage (e.g., a drain-to-source voltage) of the second transistor M2 and the voltage (e.g., a gate-to-source voltage) of the seventh transistor M7 may be set to about −27 V. In such a stage circuit, components having high internal pressure are used as the second and seventh transistors M2 and M7 such that the manufacturing cost thereof may be increased. In a stage circuit, where a high voltage is applied to the second and seventh transistors M2 and M7, power consumption is increased, and the reliability of driving is lowered. In an exemplary embodiment of the stage circuit, the first transistor M1 is provided between the third and second nodes N3 and N2, such that the voltage at the third node N3 is maintained at a voltage substantially close to the voltage of the second power source VSS, and the voltage (e.g., the drain-to-source voltage) of the second transistor M2 and the voltage (e.g., the gate-to-source voltage) of the seventh transistor M7 may be about −14 V.

In an exemplary embodiment, the first transistor M1 is coupled or connected to the second node N2, and the capacitance of a parasitic capacitor coupled to the second node N2 is thereby minimized, such that the voltage drop time of the output terminal 104, e.g., the supply time of the scan signal, is shortened, thereby improving the reliability of driving. In a stage circuit, where the first transistor M1 is omitted, the second node N2 is coupled to parasitic capacitors of the second, third and seventh transistors M2, M3 and M7. In an exemplary embodiment, where the first transistor M1 is provided to be coupled to the second node N2, the second node N2 is coupled to a parasitic capacitor of the first transistor M1.

Figure 5:
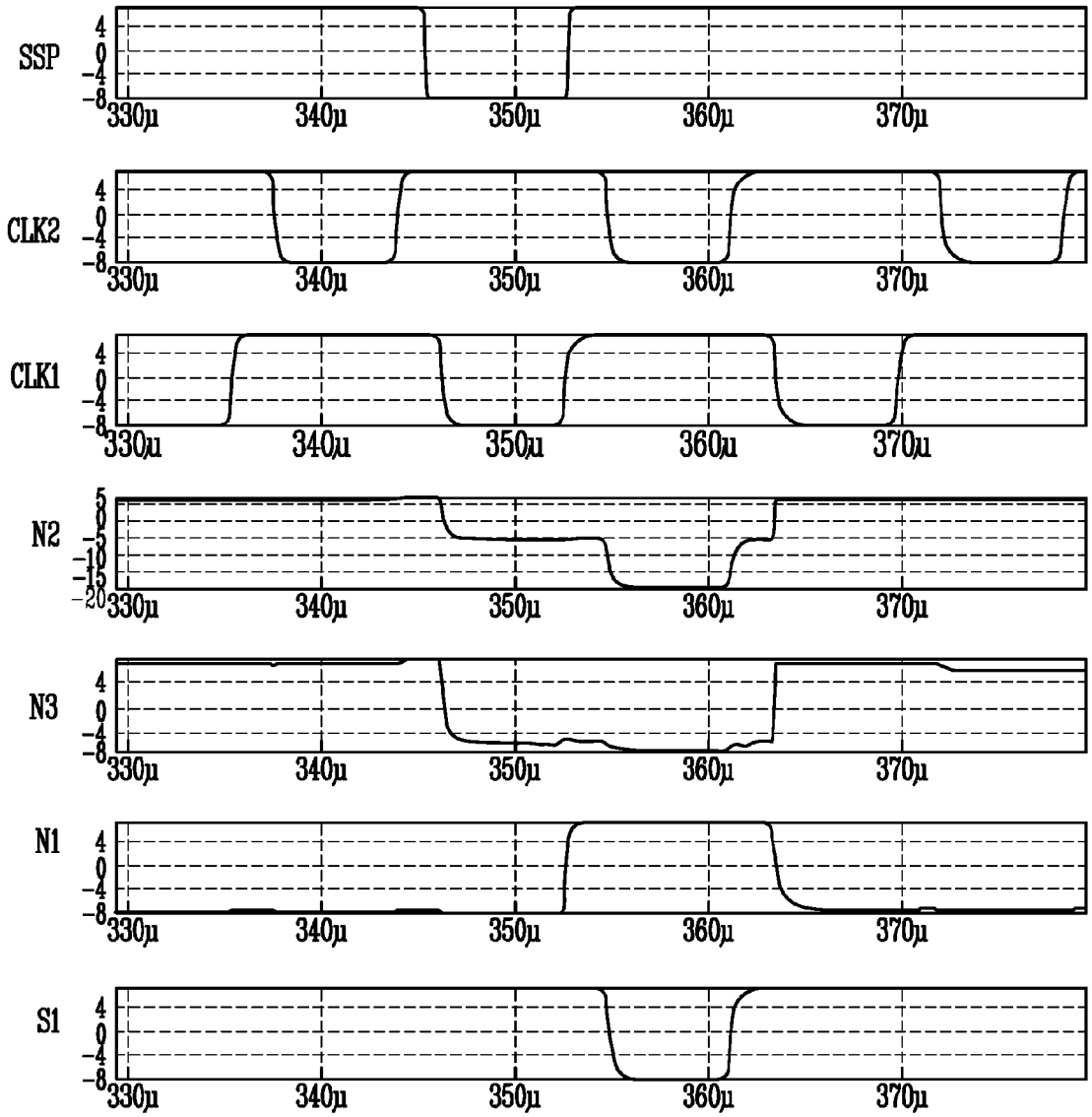
FIG. 5 is a waveform diagram illustrating a simulation result of driving the stage circuit shown in FIG. 3.

FIG. 5 is a waveform diagram illustrating a simulation result of the signals of the stage circuit shown in FIG. 3.

Referring to FIG. 5, the voltage at the third node N3 is substantially constantly maintained regardless of a voltage drop at the second node N2. As shown in FIG. 5, in an exemplary embodiment of the stage circuit, the scan signal is substantially stably output to the scan line S1, using only the two clock signals CLK1 and CLK2.

In exemplary embodiment of the invention, as described herein, an organic light emitting display includes a data driver configured to supply a data signal to data lines, a scan driver configured to sequentially supply a scan signal to scan lines, and a pixel unit configured to include a plurality of pixels connected to the scan lines and the data lines.

In such an embodiment, the pixels included in the pixel unit selectively receive a data signal supplied from the data lines based on a scan signal supplied to the scan lines. When the pixels receive the data signal, the pixels generate light with a predetermined luminance corresponding to the data signal, thereby displaying an image.

In an exemplary embodiment, the scan driver includes stage circuits coupled to the scan lines, respectively. Each stage circuit supplies a scan signal to a scan line coupled to the stage circuit, based on or in response to a signal supplied to the stage circuit. The stage circuit typically includes a plurality of transistors (e.g., 10 or more transistors) and a plurality of capacitors, and therefore, the stability of the stage circuit is lowered. When a plurality of transistors are included in the stage circuit of an organic light emitting display, the process yield of the organic light emitting display is decreased, and the stability of driving the organic light emitting display is thereby lowered.

In an organic light emitting display including an exemplary embodiment of the stage circuit according to the invention, the stage can be implemented with a relatively simple circuit, thereby improving stability. In such an embodiment, the stage circuit may generate a scan signal, using only two clock signals, and the voltage applied to the transistors is minimized, such that power consumption and manufacturing cost is substantially reduced, and the reliability of driving is substantially improved.

While the invention has been particularly shown and described with reference to exemplary embodiments thereof, it will be understood by those of ordinary skill in the art that various changes in form and details may be made therein without departing from the spirit or scope of the present invention as defined by the following claims.

What is claimed is:

1. A stage circuit, comprising:

a plurality of stages connected to each other, wherein each of the stages comprises:

an output unit configured to output a voltage of a first power source or a signal of a third input terminal to an output terminal, based on a voltage applied to a first node or a second node;

a first driver configured to control a voltage at a third node, based on signals of a first input terminal, a second input terminal and the third input terminal;

a second driver configured to control the voltage at the first node, based on the signal of the second input terminal and the voltage at the third node; and a first transistor connected between the second node and the third node and maintained in a turn-on state.

2. The stage circuit of claim 1, wherein the first input terminal receives an output signal of a previous stage or a start signal, the second input terminal receives one of a first clock signal and a second clock signal, and the third input terminal receives the other of the first clock signal and the second clock signal.

3. The stage circuit of claim 2, wherein the first and second clock signals have substantially a same period as each other, and turn-on periods of the first and second clock signals do not overlap each other.

4. The stage circuit of claim 3, wherein each of the first and second clock signals has a period of two horizontal periods, and the turn-on periods of the first and second clock signals are in different horizontal periods from each other.

5. The stage circuit of claim 2, wherein a turn-on period of the start signal overlaps a turn-on period of the first clock signal.

6. The stage circuit of claim 2, wherein the first driver comprises:

a second transistor connected between the first input terminal and the third node, wherein a gate electrode of the second transistor is connected to the second input terminal; and third and fourth transistors connected in series to each other and connected between the third node and the first power source, wherein a gate electrode of the third transistor is connected to the third input terminal, and a gate electrode of the fourth transistor is connected to the first node.

7. The stage circuit of claim 2, wherein the output unit comprises:

a fifth transistor connected between the first power source and the output terminal, wherein a gate electrode of the fifth transistor is connected to the first node;

a sixth transistor connected between the output terminal and the third input terminal, wherein a gate electrode of the sixth transistor is connected to the second node;

a first capacitor connected between the second node and the output terminal; and a second capacitor connected between the first node and the first power source.

8. The stage circuit of claim 2, wherein the second driver comprises:

a seventh transistor connected between the first node and the second input terminal, wherein a gate electrode of the seventh transistor is connected to the third node; and an eighth transistor connected between the first node and a second power source having a voltage lower than the voltage of the first power source, wherein a gate electrode of the eighth transistor is connected to the second input terminal.

9. The stage circuit of claim 8, wherein a gate electrode of the first transistor is connected to the second power source.

10. An organic light emitting display, comprising:

a plurality of pixels connected to a plurality of scan lines and a plurality of data lines;

a data driver configured to supply a data signal to the data lines; and a scan driver configured to supply a scan signal to the scan lines, wherein the scan driver comprises a plurality of stages connected each other, and each of the stages is connected to a corresponding scan line of the scan lines, wherein each of the stages comprises:

an output unit configured to output a voltage of a first power source or a signal of a third input terminal to an output terminal, based on a voltage applied to a first node or a second node;

a first driver configured to control a voltage at a third node, based on signals of a first input terminal, a second input terminal and the third input terminal;

a second driver configured to control the voltage at the first node, based on the signal of the second input terminal and the voltage at the third node; and a first transistor connected between the second and third nodes and maintained in a turn-on state.

11. The organic light emitting display of claim 10, wherein each of the stages generates the scan signal based on a clock signal supplied to the third input terminal.

12. The organic light emitting display of claim 10, wherein the first input terminal receives a scan signal of a previous stage or a start signal.

13. The organic light emitting display of claim 10, wherein the second and third input terminals of an odd-numbered stage of the stages receive a first clock signal and a second clock signal, respectively, and the second and third input terminals of an even-numbered stage of the stages receive the second clock signal and the first clock signal, respectively.

14. The organic light emitting display of claim 13, wherein the first and second clock signals have substantially a same period as each other, and turn-on periods of the first and second clock signals do not overlap each other.

15. The organic light emitting display of claim 13, wherein the first driver comprises:

a second transistor connected between the first input terminal and the third node, wherein a gate electrode of the second transistor is connected to the second input terminal; and third and fourth transistors connected in series between the third node and the first power source, wherein a gate electrode of the third transistor is connected to the third input terminal, and a gate electrode of the fourth transistor is connected to the first node.

16. The organic light emitting display of claim 13, wherein the output unit comprises:

a fifth transistor connected between the first power source and the output terminal, wherein a gate electrode of the fifth transistor is connected to the first node;

a sixth transistor connected between the output terminal and the third input terminal, wherein a gate electrode of the sixth transistor is connected to the second node;

a first capacitor connected between the second node and the output terminal; and a second capacitor connected between the first node and the first power source.

17. The organic light emitting display of claim 13, wherein the second driver comprises:

a seventh transistor connected between the first node and the second input terminal, wherein a gate electrode of the seventh transistor is connected to the third node; and an eighth transistor connected between the first node and a second power source having a voltage lower than the voltage of the first power source, wherein a gate electrode of the eighth transistor is connected to the second input terminal.

18. The organic light emitting display of claim 17, wherein a gate electrode of the first transistor is connected to the second power source.

* * * * *